US008438675B2

(12) United States Patent
Henshaw et al.

(10) Patent No.: US 8,438,675 B2
(45) Date of Patent: May 14, 2013

(54) DEVICES AND METHODS FOR BODY ELEVATION

(75) Inventors: Graham Robert Byrne Henshaw, Chicago, IL (US); Daniel A. Peterson, Chicago, IL (US); John David Hartman, Chicago, IL (US); David Chesley, Duxbury, MA (US); Jeffrey Cogan Nelson, Chicago, IL (US)

(73) Assignee: Liftseat Corporation, Lombard, IL (US)

( * ) Notice: Subject to any disclaimer, the term of this patent is extended or adjusted under 35 U.S.C. 154(b) by 0 days.

(21) Appl. No.: 13/297,044

(22) Filed: Nov. 15, 2011

(65) Prior Publication Data

US 2012/0054957 A1 Mar. 8, 2012

Related U.S. Application Data

(63) Continuation of application No. 11/747,160, filed on May 10, 2007, now Pat. No. 8,056,158.

(60) Provisional application No. 60/799,660, filed on May 12, 2006, provisional application No. 60/831,217, filed on Jul. 17, 2006.

(51) Int. Cl.
*A47K 13/10* (2006.01)

(52) U.S. Cl.
USPC ..... 4/667; 297/DIG. 10

(58) Field of Classification Search ..... 4/667, 246.1, 4/246.4, 246.5, 248, 254; 297/DIG. 10, 313, 297/330
See application file for complete search history.

(56) References Cited

U.S. PATENT DOCUMENTS

| | | | | |
|---|---|---|---|---|
| 4,587,678 | A * | 5/1986 | Love et al. | 4/667 |
| 5,142,709 | A * | 9/1992 | McGuire | 4/667 |
| 6,507,961 | B1 * | 1/2003 | Ming-Hwa | 4/667 |
| 6,754,917 | B1 * | 6/2004 | Rhoades | 4/667 |

* cited by examiner

*Primary Examiner* — Tuan Nguyen
(74) *Attorney, Agent, or Firm* — Moazzam & Associates, LLC

(57) ABSTRACT

Devices and methods are presented for elevating seat devices. The device allows a vertical and forward motion of a seat from a first position to a second position. Such motion more resembles a natural body motion during the standing motion. A similar but converse motion is also possible with movement from a standing position to a sitting position.

20 Claims, 11 Drawing Sheets

DEVICES AND METHODS FOR BODY ELEVATION

This application is a continuation of U.S. patent application Ser. No. 11/747,160, filed May 10, 2007, now U.S. Pat. No. 8,056,158; which claims priority to U.S. Provisional Patent Application Ser. No. 60/799,660, filed May 12, 2006; and to U.S. Provisional Patent Application Ser. No. 60/831,217, filed Jul. 17, 2006, the contents of both of which are hereby incorporated by reference herein in their entirety into this disclosure.

BACKGROUND OF THE INVENTION

1. Field of the Invention

The present invention relates to techniques for elevation. In particular, the present invention relates to devices and methods for body elevation.

2. Background of the Invention

The process of sitting or standing is one of the most common and routine movements for human beings. The human body is designed to be able to perform such movement with minimal effort. However, such movements, which are routine for most people, are not so routine for certain classes of people. For example, the elderly, the disabled, the obese, the pregnant, or the weak may have considerable difficulty standing or sitting. Other persons who typically have no problem with the movement of sitting or standing could also have temporary difficulty after surgery or injury. Thus, there are many situations where persons will have temporary or permanent difficulty with the routine process of sitting or standing.

Conventional devices exist in the market to assist with the movement required for sitting or standing. For example, standard crutches are typically used as an anchoring bar to hold and pull during the motion. However, a major drawback of using standard crutches is the need for considerable upper body strength to support a substantial portion of the body weight during the process of sitting or standing. Also, crutches tend to move with the shift of weight, and can often slip at the most crucial time, when the person using them is supporting all their weight on the crutches. Such movement can result in injury to the person using these crutches.

Another conventional device is a standard walker, which is a simple U-shaped device typically having four wheels that allow a user to walk with and lean against the device during movement. Although a walker is really designed to aid in walking movement, it can also be used in the same manner as a crutch, i.e. as an anchor during the motion of standing or sitting. Although the walker is typically more stable than standard crutches because it is self-supporting, the walker can still topple over if enough force or pull is exerted to tip the device over during motion. The walker also needs considerable upper body strength on the part of the user. Thus, there is still some risk of injury to the person using the walker during such motion.

Finally, a few conventional devices have been made that assist a person in standing from a sitting position. However, these devices are typically designed specifically for a toilet seat and have a one way axis of motion, resulting in a sudden jerk movement that could potentially cause harm or injury to an already weakened, fragile or injured body, as well as require additional vertical motion which a user may not have the strength to provide.

Thus, there is a need in the art for a simple and universal device to assist in the elevation of persons, by raising and lowering the person gently in a natural and fluid manner. The device should be simple to use, efficient, safe and able to be installed in a relatively short period of time.

SUMMARY OF THE INVENTION

The present invention introduces exemplary devices and methods for elevating a body into various positions, including, for example, from a standing position to a sitting position, and from a sitting position to a standing position. The elevation is made possible through a smooth and fluid movement that allows for gentle natural body motion and decreases chances of sudden or jerky movement of parts of the body that may be injured, weak or vulnerable.

As used herein and throughout this disclosure, the term "elevation" is defined as a relative change in elevation, such as a relative lifting or lowering or other movement of a portion of a body from one position to the next. Thus, positive elevation (e.g., lifting) and negative elevation (e.g., lowering) are both within the scope of the present definition and can be interpreted within the definition of "elevation" without specific reference to "positive" or "negative," or the like. As applied to the present invention, exemplary devices and methods assist in the change of elevation for a user, resulting in either a relative lifting or relative lowering of the body or portion thereof from one position to the next.

In a particular exemplary embodiment, the device is designed to work with any standard toilet. It is designed to lower a person onto the toilet from a standing position, and then lift the person back onto his or her feet when desired. This embodiment conforms to the sides of the toilet adding little extra volume. It has a plastic wall surrounding the inner mechanics of the device shielding them from the user.

The exemplary embodiments presented herein are drawn to the unique and novel mechanism of the motion, and may be applied to any device, object or item that may benefit from the use of such a device. The application of the present invention is not limited to any such specific device.

DETAILED DESCRIPTION OF THE INVENTION

The present invention presents a novel technique for elevating users from one position to the next without suffering from some of the drawbacks of conventional devices. Exemplary devices according to the present invention are designed to be rigid in frame and stable to prevent undesired movement of the device during the lifting or lowering motion, thereby decreasing the chances for injuries that may occur as a result of the loss of stability of the device, as is common in many conventional devices. Further, the motion of the device in its elevation is designed to be smooth, effortless, and reflective of the natural ergonomic motion of the body, so as to decrease the risks of injury to the body that are possible during an unnatural or jerky motion as is common in conventional devices.

Furthermore, the device is designed to be applicable in any environment where such a motion device would be beneficial, including but not limited to, vehicle seats, seats in the home (chairs, couches, sofas, beds, toilets, showers, etc.), seats in business environments (physician offices, examination rooms, waiting areas, stadiums, arenas, theaters, restaurants, airplanes, buses, etc.) and anywhere else where such a device would be beneficial, such places being known to one having ordinary skill in the art.

Figure 1A:
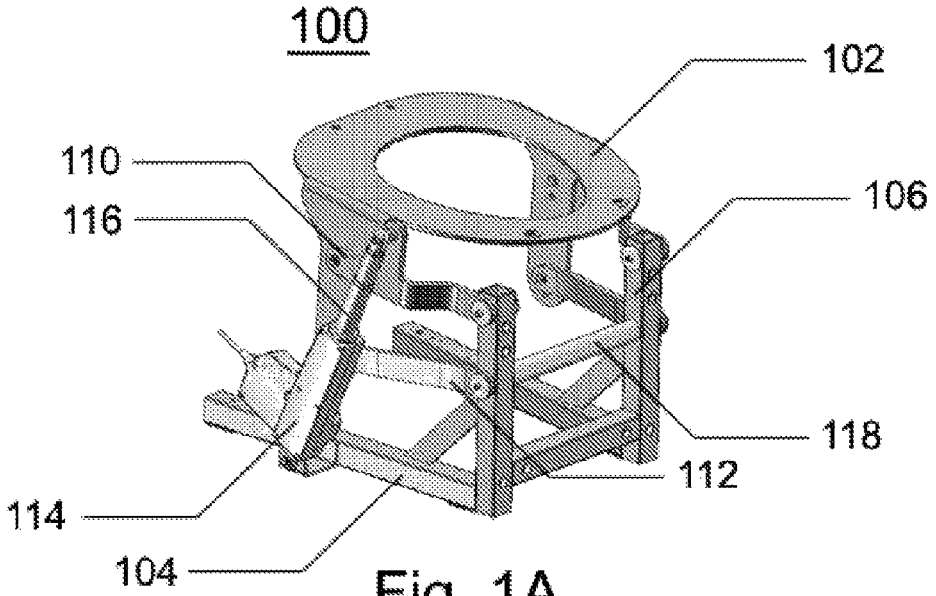
FIG. 1A shows a perspective view of an elevating device in a relatively low position according to an exemplary embodiment of the present invention.
Figure 1B:
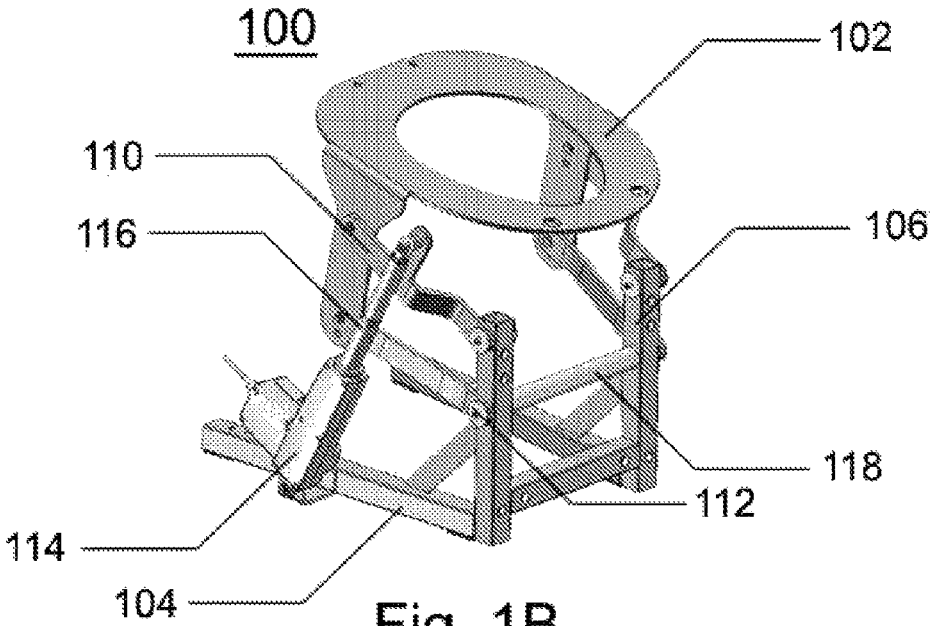
FIG. 1B shows a perspective view of an elevating device in a mid-range movement position according to an exemplary embodiment of the present invention.
Figure 1C:
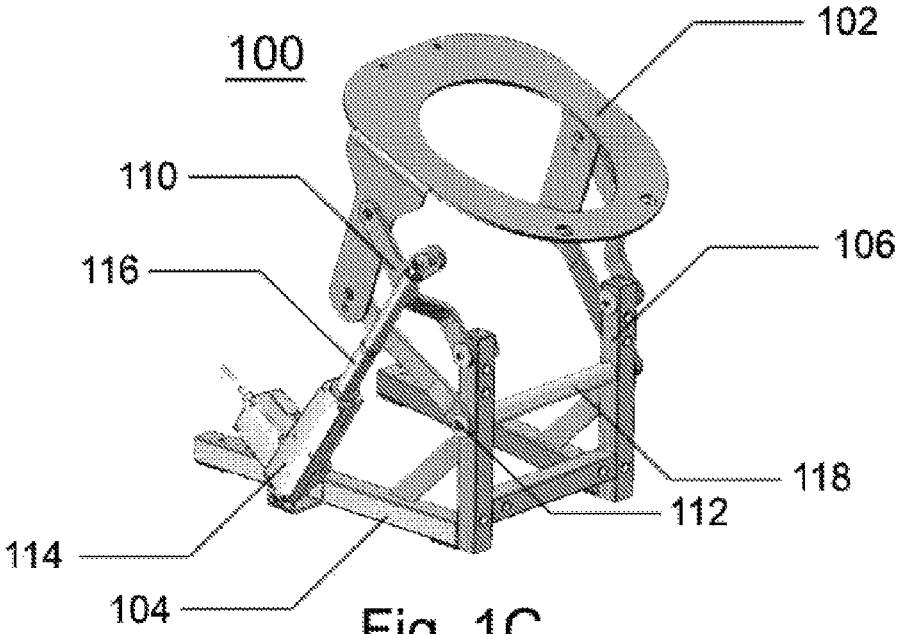
FIG. 1C shows a perspective view of an elevating device in a relatively high position according to an exemplary embodiment of the present invention.
Figure 2A:
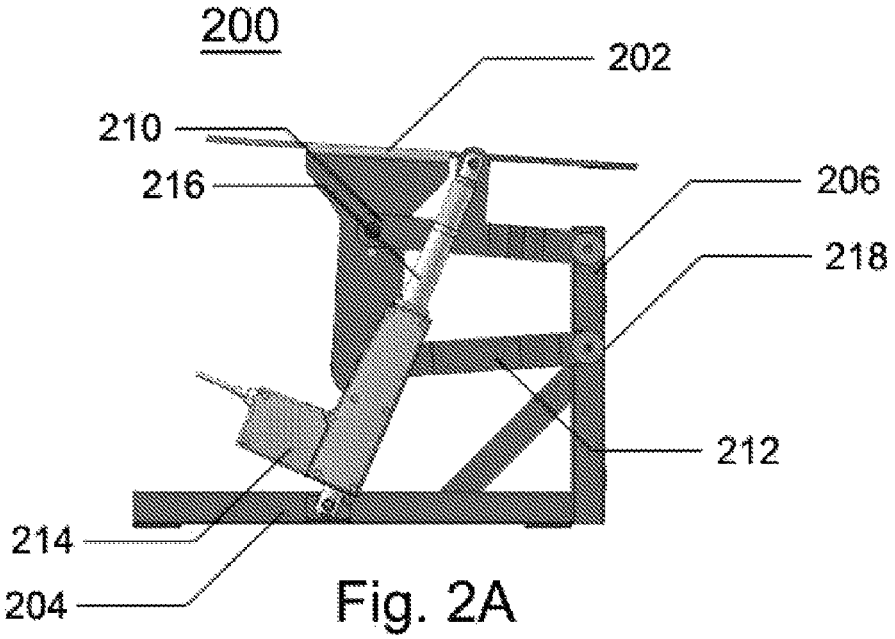
FIG. 2A shows a side view of an elevating device in a relatively low position according to an exemplary embodiment of the present invention.
Figure 2B:
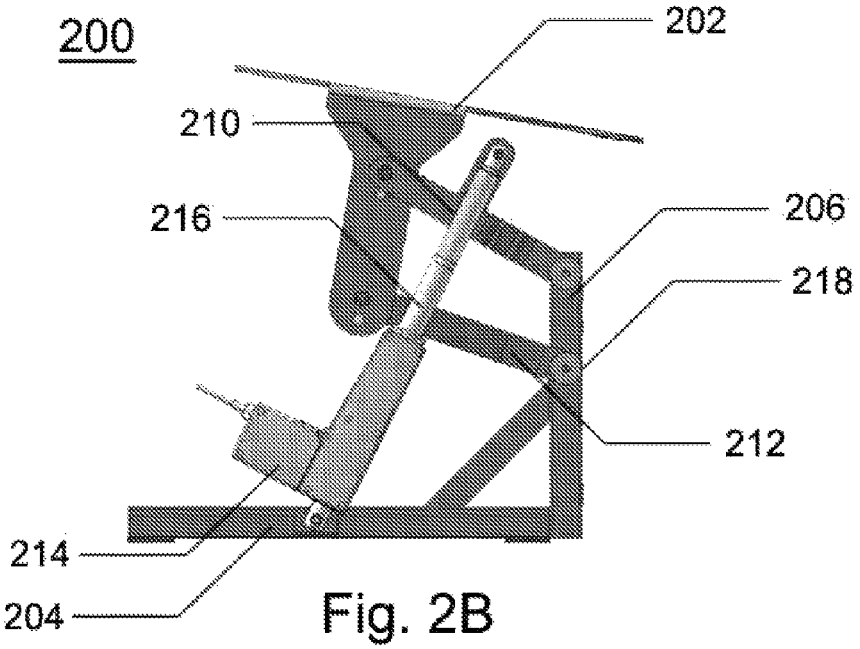
FIG. 2B shows a side view of an elevating device in a mid-range movement position according to an exemplary embodiment of the present invention.
Figure 2C:
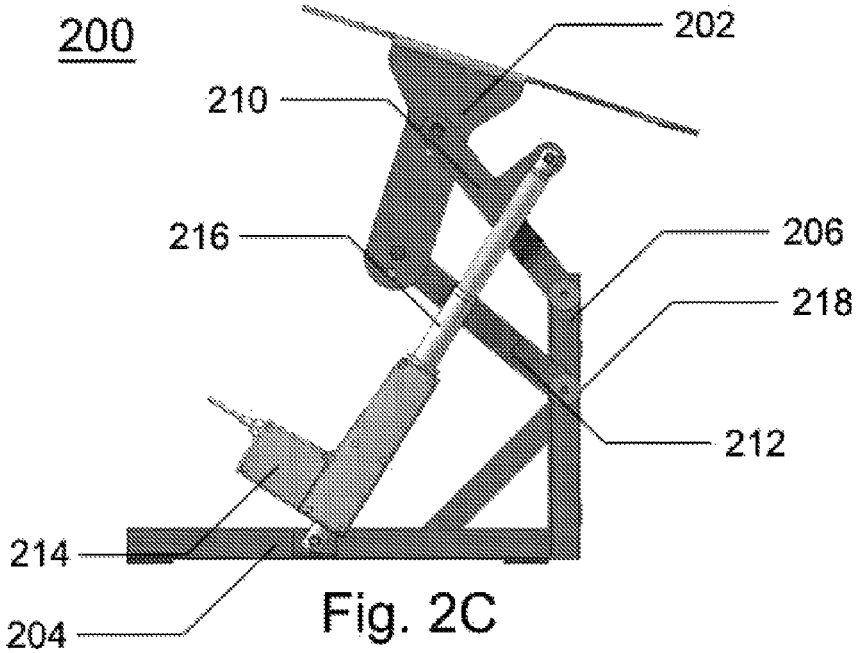
FIG. 2C shows a side view of an elevating device in a relatively high position according to an exemplary embodiment of the present invention.

In exemplary embodiments, the present invention is a lift assist device as shown in various embodiments of FIGS. 1-2. In these figures, an exemplary device is shown in both perspective (FIG. 1) and side (FIG. 2) views as it flows through the natural motion of lifting a seating portion. It should be noted that for sake of simplicity, only the lifting motion is shown in the progression of FIGS. 1 and 2, but the device can also lower in a similar but converse manner, as may be considered in the progression of the FIGS. 1C to 1B to 1A, for example.

Furthermore, consistent component labeling has been used throughout the figures such that the same or similar part has been labeled with the same two digit extension in all figures, with the first digit of each figure label signifying the figure number in which the component is first shown. For example, a "toilet" has the extension "30" and is shown as 430 in FIG. 4, 530 in FIG. 5, and so forth.

As may be gleaned from the progression of perspective FIG. 1 or side FIG. 2, a lift generator 114 serves to exert vertical force on an extension portion 116 that communicates with elongate member 110. As shown in this figure, this communication serves to transfer power to elongate member 112 to the other side. Optionally or additionally, extension portion 116 may communicate with elongate member 112 to transfer power. A substantially planar seat portion 102 is pivotally attached to elongate members 110 and 112, which are both pivotally attached to vertical member 106. Elongate member 110 is slightly shorter than elongate member 112. Drive shaft 118 connects elongate member 112 to its counterpart on the opposite side. As lift generator 114 extends extension portion 116, seat portion 102 is tilted to a predetermined angle using elongate members 110 and 112 as guides. Drive shaft 118 transfers the rotational force delivered by lift generator 114 from elongate member 112 to its counterpart on the opposite side while also ensuring that elongate members 112 and its counterpart turn in unison. Seat portion 102 is raised during the lifting motion from a substantially horizontal plane (see FIG. 1A), to a substantially angled plane (see FIG. 1C). The resting or final angle of the seat portion 102 may be pre-adjusted in a particular position during manufacturing. The final angle of the seat portion (FIG. 1C) may, but does not have to, be substantially vertical as some users may not necessarily need a complete vertical position of the seat to be able to stand up after such a vertical motion.

Lifting mechanism 114 extends extension portion 116 during lifting, but it also contracts extension portion 116 during a lowering process. In this particular embodiment there is only one lift generator, but more can be used, perhaps in the interest of fail-safety or redundancy. Another lift generator, for instance, can be located on the other side of the device 104. Considering the same relative motion in reverse, from FIGS. 1C to 1A, a user would only need to gently lean against and rest upon the angled slope of seat portion 102 and activate lifting mechanism 114 to allow the user to be gently moved into the seating position shown in FIG. 1A. When the user has a desire to stand again, lifting mechanism 114 is activated to allow for the motion back to a substantially angled position, as shown in the progression of FIGS. 1A-1C or 2A-2C. Lifting mechanism 114 can be powered by an onboard battery, or by plugging it into a nearby outlet.

It should be noted that one of many unique advantages of the present invention over conventional devices is the natural movement that results from the elevation motion of the device. Considering the natural motion of a person who is about to sit from a standing position, a side view of the motion reveals a lowering and moving backwards of the person with respect to the person's standing position. Thus, there is not only a relative vertical change in position but also a horizontal change in torso or "core" position, resulting in a person being lowered and backed up somewhat to accommodate the seating position in which the person desires to rest. The present invention seeks to support the user's torso from below (on a vertical axis), even while lowering, as well as from behind (on a horizontal axis).

In studying such natural motion, the present invention is designed to mimic such motion to a degree that the device actually lowers and backs a user during the resting motion, and conversely, raises and pushes the user gently during the lifting process. When seat portion 102 is in the angled position (as in FIGS. 1C and 2C), it provides horizontal support for the person to lean back against seat portion 102 while also providing enough vertical support so the person can begin to sit on seat portion 102. As seat portion 102 moves into the seated position, the person's weight shifts from leaning and sitting to simply sitting. The angle of seat portion 102 gradually changes to accommodate the person's shift in weight by keeping the angle of seat portion 102 substantially perpendicular to the sum of forces of the weight of the person. See, for example, FIG. 2 wherein the front edge of the planar seat portion 102 moves relatively upward and forward (away from the device) during the lifting process, resulting in the lifting and forward movement of the user with respect to the sitting position. The slight and gentle forward push of the device is designed to allow for a slight transfer of momentum to a user who does desire to use such momentum to initiate their movement off of the device. Often times, users or patients may be so weak that any slight assistance may be beneficial to initiate movement off of the device. However, the momentum is not designed to be of a magnitude as to push the user completely off of the seat portion, but to raise the user to a more natural standing position just away from the device.

In the exemplary embodiments shown in FIGS. 1 and 2, lifting mechanism 114 includes a motor that serves to push/pull a screw drive rod to initiate a lifting/lowering movement, respectively. However, the present invention is not limited to such a motor/screw drive combination and can include any other type of movement actuator, including but not limited to, hydraulic systems, pneumatic systems, screw-actuating motors, or the like. Any other movement system not specifically included in the present disclosure for sake of simplicity is still within the scope of the present invention as long as such system can produce movement as described herein.

As described above, the present invention may be useful in any environment where a desire exists to assist persons in moving from a sitting to a standing or from a standing to a sitting motion. Furthermore, the present invention may also be used to assist persons to move from a substantially horizontal position (e.g., lying down or supine) to a sitting and/or standing position, and vice versa. In general, the present invention may be used to assist a person in any relative movement from a portion or all of the body being in a substantially horizontal to a substantially inclined or vertical position, and vice versa. Other changes in body position assistance are also possible through the present invention.

The use of the present device has been described with respect to a user in general. As briefly described above, such user may be elderly, handicapped, or otherwise incapacitated. However, the present invention is not limited to such persons but can be used by anyone who desires assistance in movement from one position to another. For example, an obese individual may have significant difficulty in standing up from a laying or sitting position, but has little trouble walking once standing. The use of this device assists the obese individual in standing without aid from another individual. Thus, use of the present invention results in both cost savings (obese individual can stand and sit without aid worker, no potential injury to aid worker, etc.) and preservation of dignity and sense of autonomy for the user. These advantages are applicable to other users of the device as well, other than obese individuals.

The present invention is not limited to persons who are permanently weakened, diseased or physically affected. For example, the present invention may also be used by individuals who have temporary injuries or conditions, such as persons with sport or accidental injuries who have difficulty moving or standing. Also, persons using crutches have difficulty standing and sitting and can also benefit from the present invention. Another class of individuals who can greatly benefit from assistance in standing and sitting include pregnant women, who often have difficulty in such otherwise routine motions.

Figure 3A:
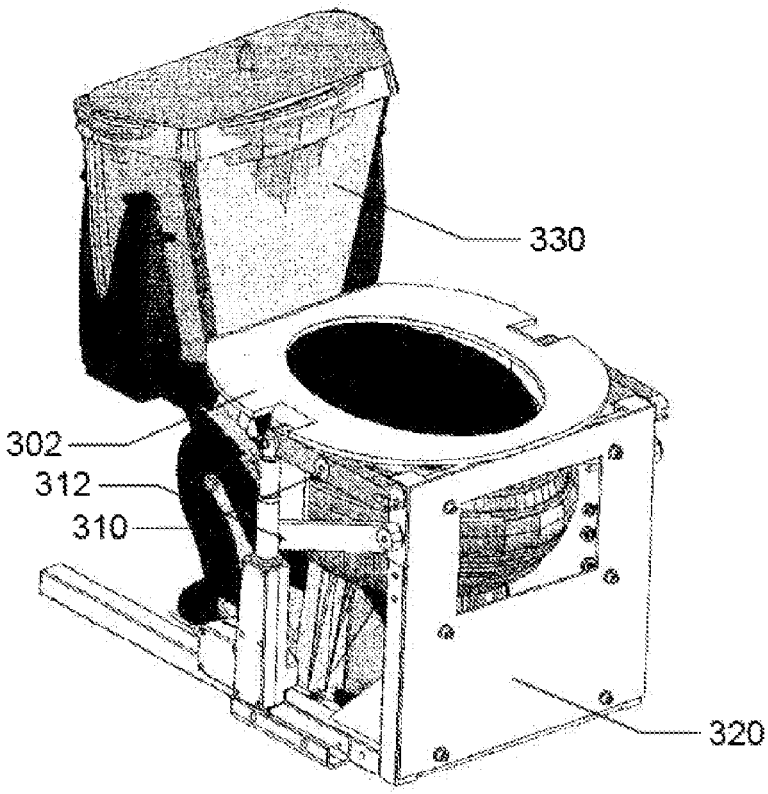
FIG. 3A shows a perspective view of an elevating device incorporated into a toilet according to an exemplary embodiment of the present invention.
Figure 3B:
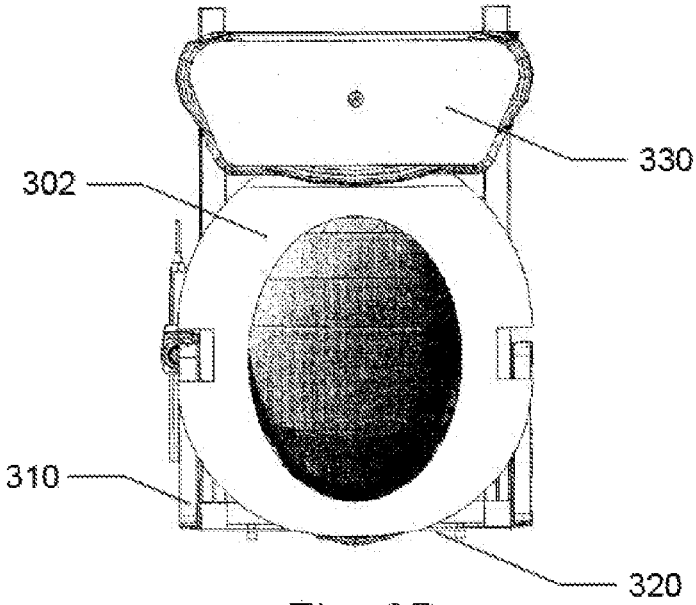
FIG. 3B shows a top view of an elevating device incorporated into a toilet according to an exemplary embodiment of the present invention.

Thus, because so many different types of people with different conditions, limitations or needs can benefit greatly from the use of the present invention, elevation devices according to the present invention may be incorporated virtually anywhere where such motion can potentially occur, including the home, businesses, motorized vehicles and the like. Taking just one non-limiting example to show how an exemplary device can be incorporated into conventional environments, FIG. 3 shows the incorporation of the device in conjunction with a conventional toilet system. Here, the device is shown in position to cradle a standard toilet 330 and anchor in place so as to minimize any unwanted movement of the device during the elevation motion. A protective front wall 320 is also shown that can serve to protect the legs of a user from any contact with moving parts of the device. In use, the elevation device can serve to lift and lower toilet seat 302 to aid a user who cannot perform these motions without assistance. The motion is substantially as described with respect to FIGS. 1 and 2. When the elevation device is installed on a toilet it is important to note that this and many other embodiments of the elevation device do not depend on the toilet for support. The embodiment is free standing and has enough strength to support itself and a person sitting on top. As such, installation of the elevation device is not permanent, and can be relocated.

The lift device according to the present invention can also be incorporated in many other environments with slight changes in the shape of the components; such slight changes as would be known to one having ordinary skill in the art. Changes in shape and components are anticipated within the present invention and all such changes are within the scope of the present invention.

Figure 4A:
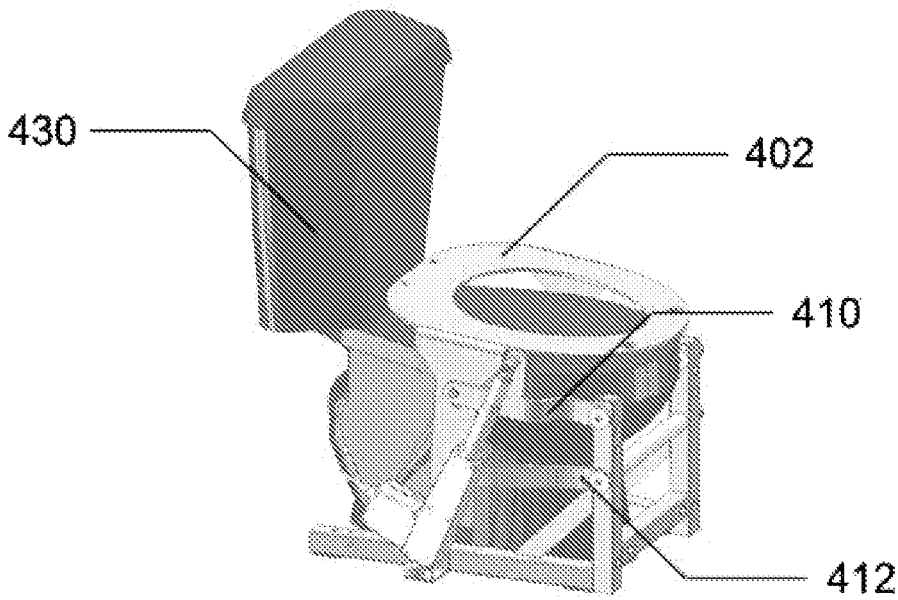
FIG. 4A shows a perspective view of an elevating device incorporated into a toilet according to another exemplary embodiment of the present invention.
Figure 4B:
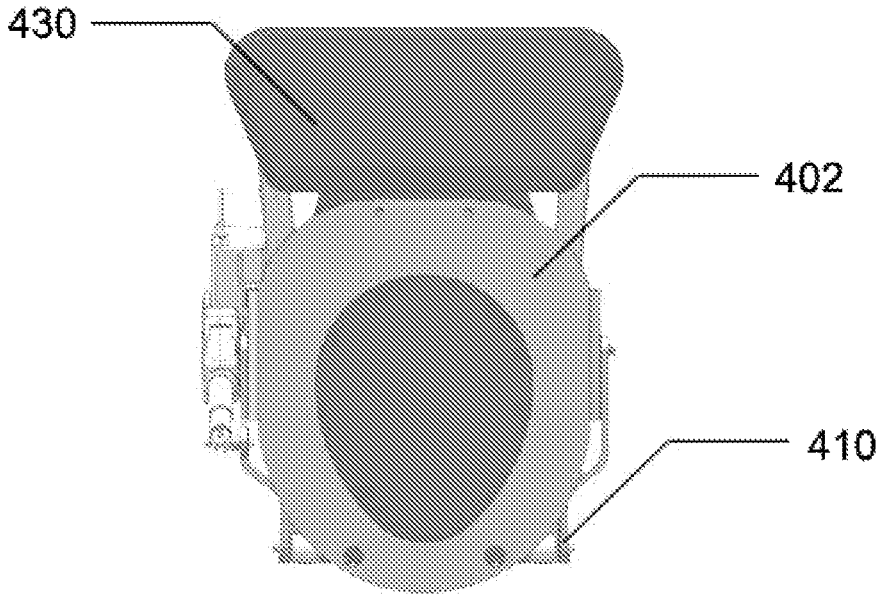
FIG. 4B shows a top view of an elevating device incorporated into a toilet according to another exemplary embodiment of the present invention.

For example, yet another exemplary embodiment of the present invention is shown in FIG. 4. This embodiment shows a lifting mechanism according to the present invention using different components. Elongate members 410 and 412 curve inward towards the front of the device to conform to the curve of the toilet 430. The difference between elongate members 410 and 412 and elongate members 310 and 312 (see FIG. 3) can best be seen by comparing FIG. 3B with FIG. 4B. The exemplary embodiment shown in FIG. 4 has a more contoured geometry to better fit upon a standard toilet. Thus, many variations in use, placement and components of the invention are possible without departing from the scope of the present invention.

Figure 5:
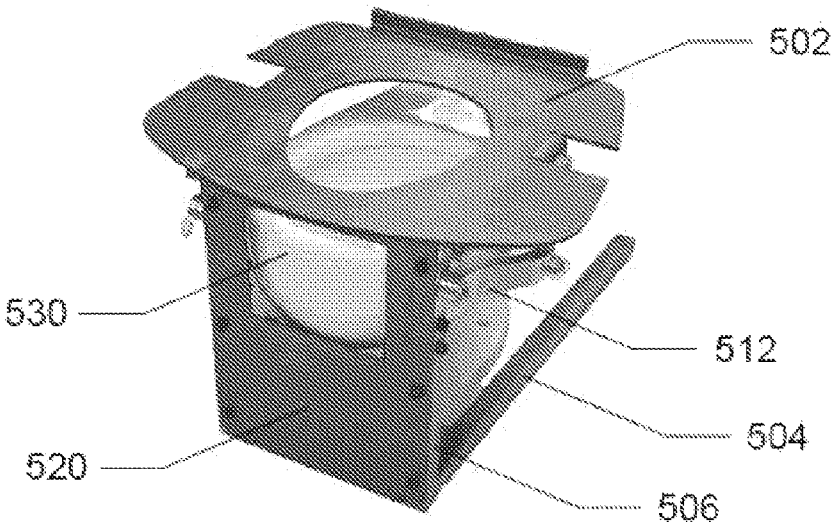
FIG. 5 shows an external perspective view of an elevating device, in a rest position, surrounding a toilet seat according to another exemplary embodiment of the present invention.

FIG. 5 shows a front perspective view of a lift device according to an exemplary embodiment of the present invention. In this figure, only the basic framework of an exemplary lift device is presented with respect to its position to a standard toilet. It is simple to ascertain the ease with which the present device may be positioned around such a toilet. The basic framework of a device according to the present invention is relatively lightweight and easy to transport and handle, on account of its few components and moving parts, as compared to conventional lifting devices currently on the market. Thus, less required parts result in less weight and less moving parts, less cost to manufacture, produce, and purchase, less likelihood of component failure or breakage, and the like. Less weight also results in less effort to move, clean, transport, store, and fold, just to name a few advantages. Other advantages are also apparent to one having ordinary skill in the art.

Figure 6:
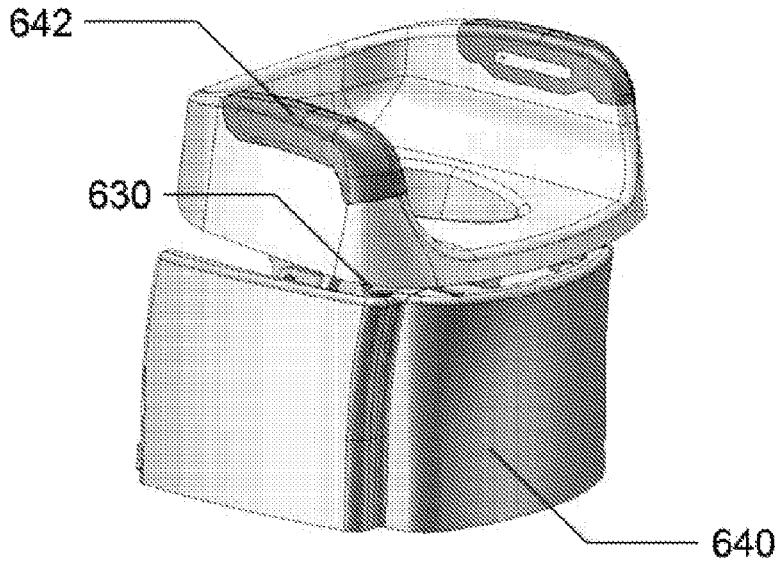
FIG. 6 shows an external perspective view of an elevating device, in a rest position, surrounding a toilet seat with a cover surrounding the elevating device according to another exemplary embodiment of the present invention.
Figure 7:
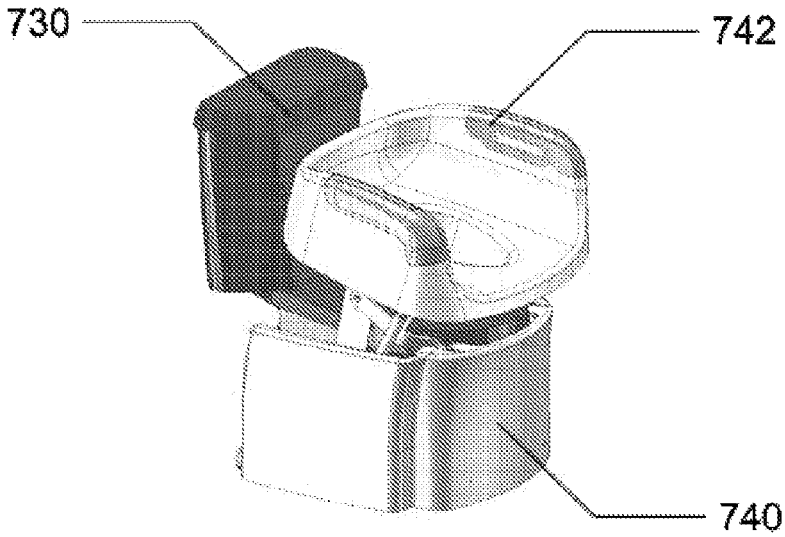
FIG. 7 shows an external perspective of an elevating device, in a lifted position, surrounding a toilet seat with a cover surrounding the elevating device according to another exemplary embodiment of the present invention.

Furthermore, the lift device according to the present invention can also include a housing or a covering to increase safety and avoid injury, as well as present an aesthetic face to a unique and advantageous lifting mechanism. Such cover also maintains the lifting mechanism in a relatively "clean" environment by acting as a shield for potential liquids or matter that may cause corrosion, rusting or other deterioration of the materials composing its parts. FIGS. 6 and 7 show embodiments of the present invention with a protective housing 640, 740 surrounding the device (about a toilet 630, 730) in the rest and lifted positions, respectively. Such housing 640, 740 may be, for example, plastic or other suitable material, preferably lightweight and easy to clean, transport and maintain. Protective housing 640, 740 may also feature gripping surfaces 642, 742. These can be made from a textured surface using rubber, plastic, or any other suitable material. Gripping surfaces 642, 742, the wide open front, and the soft contours make this embodiment suitable for entry from a wheelchair.

Figure 8:
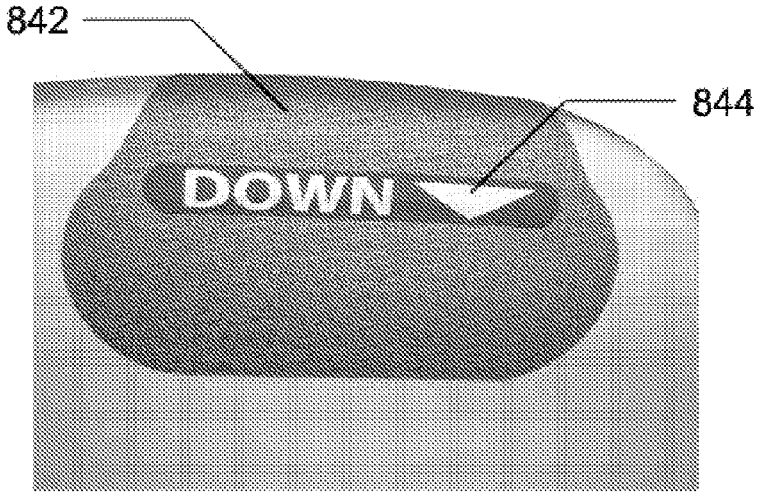
FIG. 8 shows an external perspective of an elevating device, featuring a "down" button and marker on a gripping surface according to another exemplary embodiment of the present invention.
Figure 9:
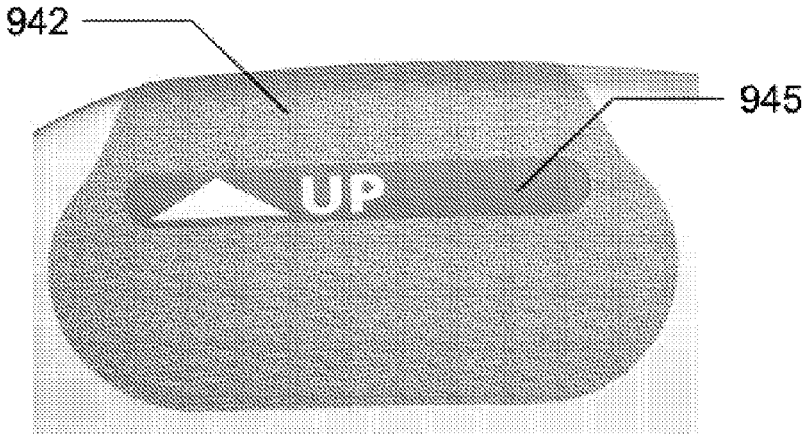
FIG. 9 shows an external perspective of an elevating device, featuring an "up" button and marker on a gripping surface according to another exemplary embodiment of the present invention.

During motion as described with respect to the above figures (see, for example, FIGS. 1 and 2), the toilet seat with its aesthetic and protective cover 640, 740 may be elevated to various positions to ease the lifting and seating process for a user. Such lifting and seating processes may be controlled by the user through easily accessible buttons, such as "down" 844 and "up" 945 buttons similar to those shown with respect to FIGS. 8 and 9, respectively. The exemplary device may be equipped with such large and clearly labeled buttons for readability, accessibility, instruction and safety.

Figure 10A:
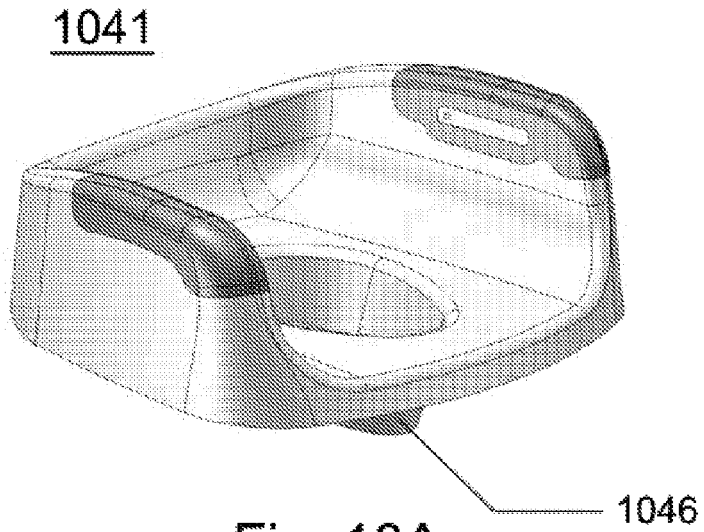
FIG. 10A shows an external perspective of a cover for an elevating device with gripping surfaces and a splash guard according to another exemplary embodiment of the present invention.
Figure 10B:
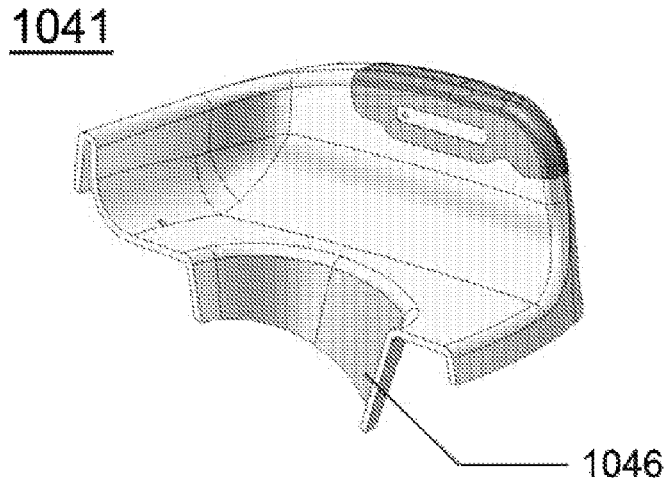
FIG. 10B shows a cross-sectional view of a cover for an elevating device with gripping surfaces and a splash guard according to another exemplary embodiment of the present invention.

FIG. 10A shows the upper half of protective housing 640, 740, upper portion 1041. In this figure a splash guard member 1046 can be seen underneath upper portion 1041. Once the elevating device is installed over a toilet, splash guard member 1046 rests inside the bowl of the toilet, directing all of the user's waste into the toilet bowl. Splash guard member 1046 helps to maintain a toilet's cleanliness while the elevating device is installed. Splash guard member 1046 can also be seen in FIG. 10B, which shows a cross-sectional view of upper portion 1041.

Figure 11:
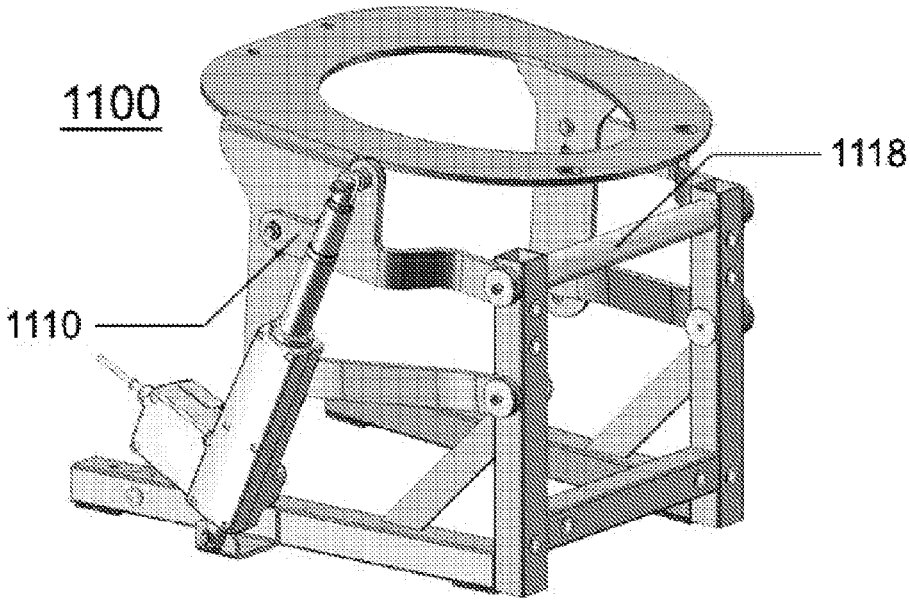
FIG. 11 shows a perspective view of an elevating device with an alternate drive shaft location according to another exemplary embodiment of the present invention.
Figure 12:
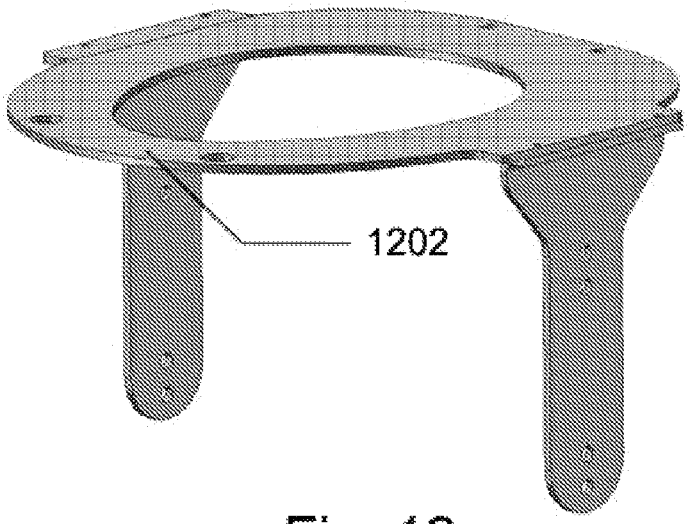
FIG. 12 shows a perspective view of a seat portion of an elevating device according to another exemplary embodiment of the present invention.
Figure 13:
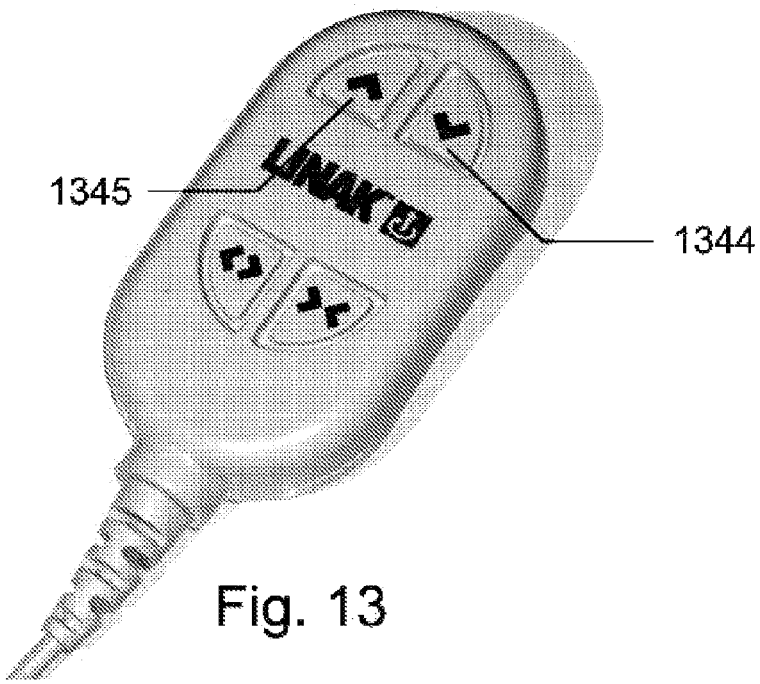
FIG. 13 shows a perspective view of a remote controller for a lifting device according to another exemplary embodiment of the present invention.

In other exemplary embodiments of the present invention certain components will vary. The drive shaft can be in alternate locations, for example, as in FIG. 11 which shows drive shaft 1118 connecting elongate member 1110 to its counterpart on the opposite side. FIG. 12 shows a seat portion 1202 according to an exemplary embodiment of the present invention, also shown in FIGS. 1 and 2. This seat portion 1202 has the substantially planar portion on the top, and two extensions that come down on each side to help connect the elongate members such as 110 and 112 from FIG. 1. The elevation controls can also be used on a remote control such as the exemplary embodiment of that controller shown in FIG. 13. The "down" button 1344 and "up" button 1345 are placed on a remote control for easier access.

The disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device for seat elevation, the device comprising:

a horizontal base portion fixedly connected to a substantially vertical support portion;

an elongated lift generator that extends and contracts along a longitudinal axis, the lift generator pivotally connected to the horizontal base portion;

a plurality of elongate members pivotally connected to the vertical support portion, the plurality of elongate members including a first elongate member pivotally connected to the lift generator on a first side of the horizontal base portion;

a drive shaft coupled to the first elongate member connecting the first elongate member to a second elongate member on a second side of the horizontal base portion, the drive shaft transferring rotational force delivered by the elongated lift generator from the first elongate member to the second elongate member; and a seat portion attached to a plurality of vertical seat supports positioned substantially perpendicular to the planar seat portion, the plurality of vertical seat supports pivotally connected to the plurality of elongate members;

wherein as the lift generator extends, the plurality of elongate members guide the motion of the seat portion in a direction substantially parallel to the longitudinal axis of the lift generator from a first position, in which the seat portion is substantially horizontal and substantially centered over the base portion, to a second position, in which the seat portion is substantially perpendicular to the longitudinal axis of the lift generator and centered closer to the vertical support portion.

2. The device of claim 1, further comprising a toilet including a toilet seat, the toilet positioned such that the toilet seat is located underneath the seat portion and within substantial proximity of the seat portion.

3. The device of claim 2, wherein the seat portion includes a splash guard member extending downward from an inner opening in the seat portion.

4. The device of claim 3, wherein the splash guard member extends below the toilet seat when the seat portion is in the first position.

5. The device of claim 1, further comprising a protective cover.

6. The device of claim 5, wherein the protective cover includes a plurality of one of handles and hand grips.

7. The device of claim 5, wherein the protective cover includes an upper portion attached to the seat portion and a lower portion attached to one of the horizontal base portion and vertical support.

8. The device of claim 7, wherein the upper and lower portions of the protective cover are in contact when the seat portion is in the first position.

9. The device of claim 1, wherein the extension of the lift generator is activated by electronic buttons.

10. A device for seat elevation, the device comprising:

a base portion adapted to be placed around a front of a toilet, the base portion including a vertical support attached near the front of the toilet;

an elongated lift generator pivotally connected to the base portion;

a plurality of elongate members pivotally connected to the vertical support portion, the plurality of elongate members including a first elongate member pivotally connected to the lift generator on a first side of the horizontal base portion;

a drive shaft coupled to the first elongate member connecting the first elongate member to a second elongate member on a second side of the horizontal base portion, the drive shaft transferring rotational force delivered by the elongated lift generator from the first elongate member to the second elongate member; and a seat portion pivotally connected to the plurality of elongate members;

wherein as the lift generator extends, the plurality of elongate members guide the motion of the seat portion in a direction substantially parallel to a longitudinal axis of the lift generator from a first position, in which the seat portion is substantially horizontal and substantially centered over the base portion, to a second position, in which the seat portion is substantially perpendicular to the longitudinal axis of the lift generator and centered closer to the vertical support portion.

11. The device of claim 10, further comprising a protective cover, the protective cover including an upper portion attached to the seat portion and a lower portion attached to the base portion.

12. The device of claim 11, wherein the upper and lower portions of the protective cover are in contact when the seat portion is in the first position.

13. The device of claim 11, wherein the upper portion includes a splash guard member extending downward from an inner opening in the seat portion.

14. The device of claim 13, wherein the splash guard member extends below a toilet seat when the seat portion is in the first position.

15. The device of claim 14, further comprising a toilet including a toilet seat, wherein the splash guard member extends below the toilet seat when the seat portion is in the first position.

16. The device in claim 11, wherein the upper portion includes a plurality of one of handles and hand grips.

17. A method for elevation of a seat connected to an assembly, the assembly including a horizontal base portion fixedly connected to a substantially vertical support portion, an elongated lift generator pivotally connected to the horizontal base portion, a plurality of elongate members pivotally connected to the vertical support portion, the plurality of elongate members including a first elongate member pivotally connected to the lift generator on a first side of the horizontal base portion, a drive shaft coupled to the first elongate member connecting the first elongate member to a second elongate member on a second side of the horizontal base portion, the drive shaft transferring rotational force delivered by the elongated lift generator from the first elongate member to the second elongate member, and a seat portion attached to a plurality of vertical seat supports positioned substantially perpendicular to the planar seat portion, the plurality of vertical seat supports pivotally connected to the plurality of elongate members, the method comprising:

extending the lift generator along a longitudinal axis;

wherein as the lift generator extends, the plurality of elongate members guide the motion of the seat portion in a direction substantially parallel to the longitudinal axis of the lift generator from a first position, in which the seat portion is substantially horizontal and substantially centered over the base portion, to a second position, in which the seat portion is substantially perpendicular to the longitudinal axis of the lift generator and centered closer to the vertical support portion.

18. The method of claim 17, further comprising contracting the lift generator along the longitudinal axis.

19. The method of claim 18, wherein the contracting includes matching an upper portion of a protective housing with a lower portion of the protective housing.

20. The method of claim 17, wherein the extending is activated upon input from a button coupled to the seat portion.

* * * * *